US007076905B2

(12) United States Patent
Zouboulakis

(10) Patent No.: US 7,076,905 B2
(45) Date of Patent: Jul. 18, 2006

(54) PNEUMATIC PAINTBALL MARKER, UNIVERSAL BARREL, ADAPTOR AND INSERT COMBINATION

(76) Inventor: Terry Zouboulakis, 4620 Beauchesne, Laval (Québec) (CA) H7T 2T6

( * ) Notice: Subject to any disclaimer, the term of this patent is extended or adjusted under 35 U.S.C. 154(b) by 0 days.

(21) Appl. No.: 10/664,177

(22) Filed: Sep. 17, 2003

(65) Prior Publication Data

US 2005/0066953 A1 Mar. 31, 2005

(30) Foreign Application Priority Data

Sep. 9, 2003 (CA) ..... 2440556

(51) Int. Cl.
*F41A 21/00* (2006.01)

(52) U.S. Cl. ..... 42/76.01; 124/83; 124/84

(58) Field of Classification Search ..... 124/83, 124/84, 85; 42/76.01–76
See application file for complete search history.

(56) References Cited

U.S. PATENT DOCUMENTS

| | | | | |
|---|---|---|---|---|
| 4,644,930 | A | 2/1987 | Mainhardt | |
| 5,228,427 | A | 7/1993 | Gardner, Jr. | |
| 5,333,529 | A * | 8/1994 | Brockman | 89/14.3 |
| D353,853 | S | 12/1994 | Albritton | |
| 5,425,298 | A | 6/1995 | Coburn | |
| 5,509,345 | A * | 4/1996 | Cyktich | 89/14.05 |
| 5,666,756 | A * | 9/1997 | Moller | 42/77 |
| 5,698,810 | A * | 12/1997 | Rose | 89/14.3 |
| 6,052,935 | A * | 4/2000 | Howard | 42/79 |
| 6,112,447 | A * | 9/2000 | Androsov | 42/79 |
| D435,884 | S | 1/2001 | Dehaan | |
| 6,273,080 | B1 | 8/2001 | Sullivan, Jr. | |
| 6,453,593 | B1 | 9/2002 | Dillon | |
| 6,494,195 | B1 * | 12/2002 | Perry et al. | 124/84 |
| 6,655,372 | B1 * | 12/2003 | Field et al. | 124/83 |
| 6,668,815 | B1 * | 12/2003 | Fernandez | 124/83 |
| 6,722,254 | B1 * | 4/2004 | Davies | 89/14.3 |
| 2001/0050077 | A1 | 12/2001 | Sullivan, Jr. | |
| 2002/0046610 | A1 | 4/2002 | Colby | |
| 2002/0104523 | A1 | 8/2002 | Juan | |
| 2002/0179074 | A1 | 12/2002 | Sullivan, Jr. | |
| 2003/0041849 | A1 | 3/2003 | Perry et al. | |
| 2003/0182838 | A1 * | 10/2003 | Kessler | 42/79 |

* cited by examiner

*Primary Examiner*—Troy Chambers
(74) *Attorney, Agent, or Firm*—Schweitzer Cornman Gross & Bondell LLP

(57) ABSTRACT

The present invention comprises a pneumatic paintball marker for use with an adaptor, the pneumatic paintball marker comprising a marker body which has a back portion and a front portion. The back portion is adapted to receive a paintball and the front portion is adapted to detachably connect with a barrel to discharge a paintball through the barrel. The barrel comprising a hollow elongated cylindrical tube, which comprises an interior diameter, a breech end and a connection means at the breech end and adapted for connection with the front portion of the marker and a paintball discharge muzzle end.

4 Claims, 7 Drawing Sheets

PNEUMATIC PAINTBALL MARKER, UNIVERSAL BARREL, ADAPTOR AND INSERT COMBINATION

FIELD OF THE INVENTION

This invention relates to the use of an adaptor in a pneumatic paintball marker in combination with a universal barrel, removable tubular barrel sleeve inserts and exchangeable variable length muzzle ends.

BACKGROUND OF THE INVENTION

The popularity of the recreational sport of paintball has risen significantly over the last few years. Tournaments are now being scheduled almost every weekend and professional national and international paintball competitions are becoming more and more popular. All cites, whether large or small are seeing indoor paintball fields being built in addition to the many outdoor playing fields. With the increase in popularity of this sport, the caliber of the players has also increased significantly. Players are now equipping themselves with top-of-the-line protective gear, paintball markers and accessories.

A paintball game requires that each player have a paintball marker and as many paintballs as they can carry. There are numerous types of scenarios that can be played out during a paintball game whether as part of a team or individually, but, in essence, the objective is avoiding to be marked by a paintball. Once marked, a player is removed from the game. The last unmarked player or team remaining on the field at the end of the allotted time is the winner of the game.

Pneumatic paintball markers discharge a paint filled paintball capsule from a paintball marker, through the breech end of the barrel portion, into the barrel and the paintball is then projected out of the muzzle end of the barrel towards its intended target. A paintball being discharged from a pneumatic paintball marker should reach an approximate velocity of 300 feet per second using as little resources as possible, such as compressed air or nitrogen, which is largely determined by the paintball barrel and as such shooting more accurately. Thus, the type of paintball barrel selected by a player is one of the most important pieces of equipment.

Paintballs can vary in size and are usually made of a non-toxic, water-soluble biodegradable paint. U.S. Pat. Nos. 4,656,092; 5,353,712, and 5,823,173 are directed to fluid-filled capsule marking paintballs. Thus, when an opponent is marked with these types of paintballs, the fluid-filled capsules burst and the paint is released and marks the opponent. Although paintball capsules appear to be spherical in shape and can have a diameter of between 0.670 inches to 0.695 inches, they are never perfectly round and each paintball manufactured varies in diameter. The inconsistency in the diameters of paintball capsules is because the paintballs must be sufficiently rigid to withstand being projected from a paintball marker while, at the same time, sufficiently fragile to break upon impact with the intended target. Furthermore, the change in ambient temperature and humidity will also cause the paintball to change in size. Moreover, every paintball manufacturer will make a different paintball once again resulting in variations in paintball sizes, which further adds to the importance of the barrel. It is extremely important to match the size of the paintballs that are being used with the size of the inner diameter of the barrel because too tight a fit will decrease the velocity and the travel/projectile distance of the paintball, in addition to possibly breaking the paintball within the barrel. Too loose a fit will also decrease the velocity, distance and accuracy of the paintball due to air loss between the paintball and the inside diameter of the barrel. Moreover, a loose fit may also cause the paintball to simply fall out of the barrel. Therefore, it is desirable that a barrel for a paintball be adapted to account for the various dimensions of paintball capsules.

As such, paintball barrels are available with different internal diameters to accommodate the different sizes and fluctuations of temperature. Barrels are also available in different lengths to improve on distance and accuracy. The drawback to conventional barrels are that a player would need approximately fifteen barrels to accommodate the different paintball sizes and barrel lengths. As barrels are usually fairly long and heavy, this extra equipment would make it inconvenient and uncomfortable for a paintball player. In addition, most barrels are expensive, thus the need for multiple barrels would significantly increase the costs associated with this sport.

U.S. application Ser. No. 10/274,075, and U.S. Pat. No. 6,494,195 disclose a barrel assembly for a pneumatic paintball gun comprising a barrel body and a barrel insert. The barrel insert collaborates with the barrel body to provide a firing bore for the barrel assembly; the insert guides a paintball fired from the breech end of the gun through the barrel and out the muzzle end of the barrel body. Although this application does deal with the problem of having to carry multiple barrels in order to be able to adapt to the various sizes of paintballs, the inserts described do not extend through the majority of the barrel's overall length. Thus they fail to adequately stabilize the paintball path and sufficiently address the changes to the paintball shape caused by fluctuations in temperature or inconsistencies in the manufacturing of paintballs.

In addition, based on the art in the field of paintball markers, should a player decide to change the make of his/her pneumatic paintball marker, the corresponding barrel can no longer be used with the new marker because the connecting means on the new marker is not compatible with the old barrel. Thus, there is a need to accommodate paintball players by providing them with adaptor(s) that can be used on various markers. Therefore, there is a need for the use of adaptor(s) in combination with a universal barrel and one or more removable tubular barrel sleeve inserts and exchangeable variable length muzzle ends.

SUMMARY OF THE INVENTION

It is an object of the present invention to provide for the use of adaptor(s) in combination with a pneumatic paintball marker, a detachable universal barrel, one or more removable tubular barrel sleeve inserts, an adaptor and exchangeable variable length muzzle ends.

Another object of the present invention is to allow a paintball player to easily adapt the inside diameter of the barrel to the paintball capsules diameter by inserting a removable tubular sleeve in accordance with the diameter of the paintballs being used.

A still further object of the present invention is to allow a paintball player to change paintball markers easily and conveniently without the need of re-purchasing a multiplicity of barrels.

A still further object of the present invention is to improve the accuracy of the projection of a paintball discharged from a paintball marker.

An additional object of the present invention is to provide a kit comprising a detachable universal barrel, one or more adaptor(s), one or more removable tubular barrel sleeve inserts and one or more exchangeable variable length muzzle ends.

A still further object of the present invention is the ability to project paintballs using less resources, such as nitrogen, compressed air etc., thus extending the playing time.

It is still a further object of the present invention to provide adaptor(s) that can be adaptably connected to almost any existing paintball marker such that the detachable universal barrel can be used without substitution.

The present invention comprises a pneumatic paintball marker for use with an adaptor, the pneumatic paintball marker comprising a marker body which has a back portion and a front portion. The back portion is adapted to receive a paintball and the front portion is adapted to detachably connect with a barrel to discharge a paintball through the barrel. The barrel comprising a hollow elongated cylindrical tube, which comprises an interior diameter, a breech end and a connection means at the breech end and adapted for connection with the front portion of the marker and a paintball discharge muzzle end.

The improvement consists of the use of an adaptor which will permit a paintball player to connect a detachable universal barrel to a paintball marker. In a preferred embodiment, the adaptor comprises a body with a hollow cylindrical tube, a marker end adapted for connection with the front portion of the marker and a barrel connection for connection with a universal barrel adapted for detachable connection with the adaptor. The body of the adaptor has an internal diameter equal to the internal diameter of the universal barrel.

There are one or more removable tubular barrel sleeve inserts adapted to be inserted into the adaptor and universal barrel and to extend the entire length within the universal barrel and the adaptor. These inserts comprise a hollow elongated tube with an inside diameter and an outside diameter, the outside diameter being slightly smaller than the internal diameter of the universal barrel and adapted to form a continuous path for the projection of a paintball discharged from a paintball marker. The inserts can be made from, for example, any material, such as aluminum, brass, bronze, Teflon or any suitable material that will be able to accommodate the various sizes of the paintballs. The inside of the inserts may be coated with ceramic, oil or Teflon or any suitable material that will provide a smooth lubricated surface for an improved projection of the paintball. The inserts extend from the beginning of the marker end of the adaptor through the universal barrel. The inserts may be of various lengths and preferably extend up to 12 inches long or more and have an inside diameter that may vary from at least about 0.670 inches to at least about 0.695 inches. The inserts can be inserted in any direction and can be secured in place by screwing the muzzle end which in turn secures the insert between the marker and the muzzle.

The invention also contemplates a pneumatic paintball kit for use with a pneumatic paintball marker comprising a marker body having a back portion and a front portion. The back portion of the marker body is adapted to receive a paintball and the front portion is adapted to detachably connect with a barrel to discharge a paintball through the barrel. The barrel comprising a hollow elongated cylindrical tube with an interior diameter, a breech end and a connection means at the breech end and adapted for connection with the front portion of the paintball marker and a paintball discharge muzzle end. The kit comprises a universal barrel having a hollow elongated cylindrical tube with an interior diameter, a breech end and a connection means at the breech end and adapted for connection with the front portion of the marker and a paintball discharge muzzle end. There is also at least one adaptor comprising a body with a hollow cylindrical tube. Each adaptor comprises a marker end adapted for connection with the front portion of a marker and a barrel connection for connection with a universal barrel adapted for detachable connection with the adaptor. The body of all the adaptors has an internal diameter equal to the internal diameter of the universal barrel. The kit further comprises one or more removable tubular barrel sleeve inserts adapted to be inserted within the adaptor, the universal barrel and to extend the entire length within the universal barrel, and the adaptor. The inserts comprising a hollow elongated cylindrical tube with an inside diameter and an outside diameter, the outside diameter is slightly smaller than the internal diameter of the universal barrel, and the adaptor to form a continuous path for the projection of a paintball discharged from the paintball marker. In another embodiment, the kit comprises an interchangeable muzzle extension that is adapted for connection at the muzzle discharge end of the universal barrel.

DETAILED DESCRIPTION

The foregoing objects and advantages of the present invention will become more readily apparent from the following detailed description of the preferred embodiments made in reference to the attached figures.

Figure 1:
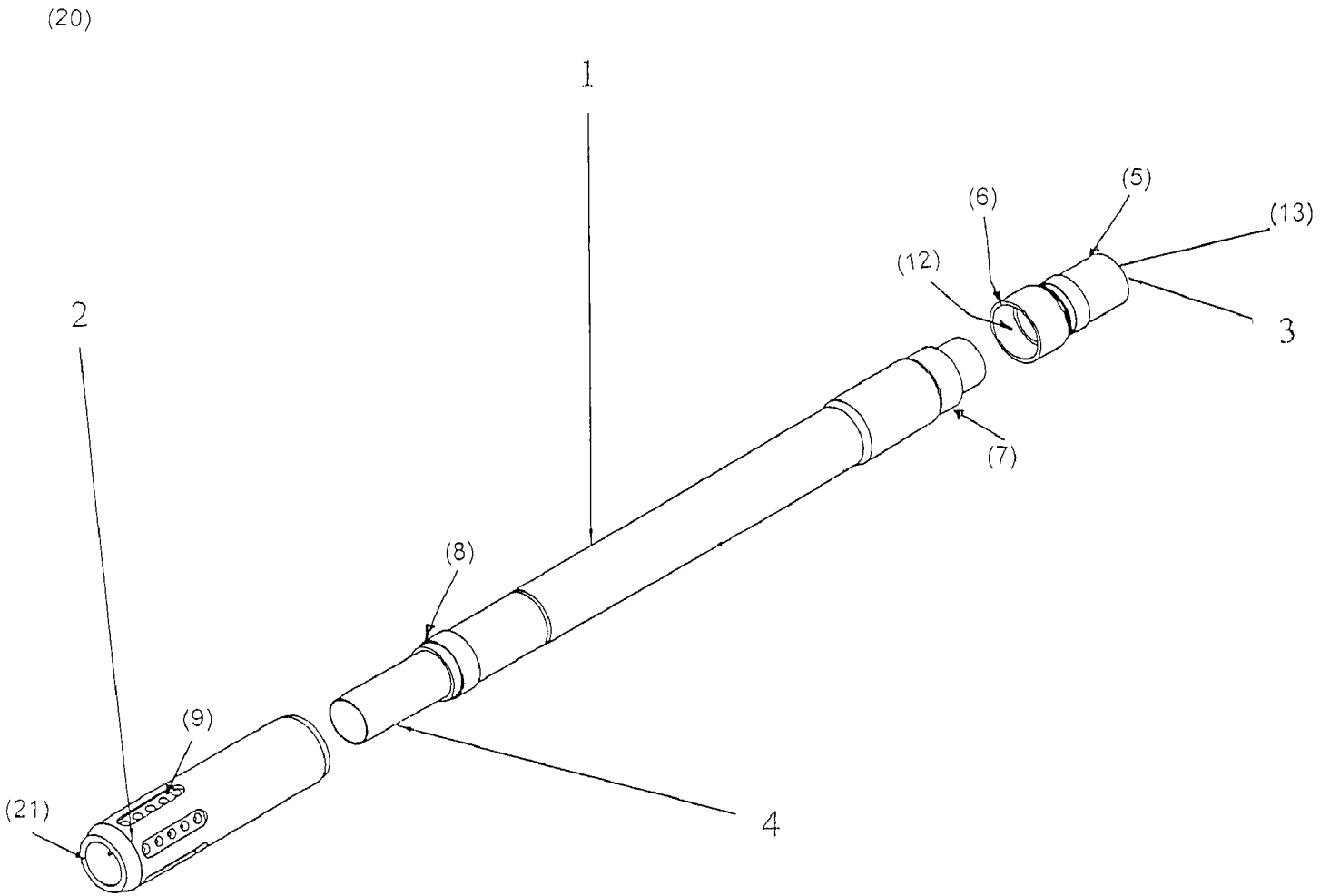
FIG. 1 is a side view of a universal barrel, adaptor, removable tubular barrel inserts and a muzzle extension combination for a pneumatic paintball marker.
Figure 7:
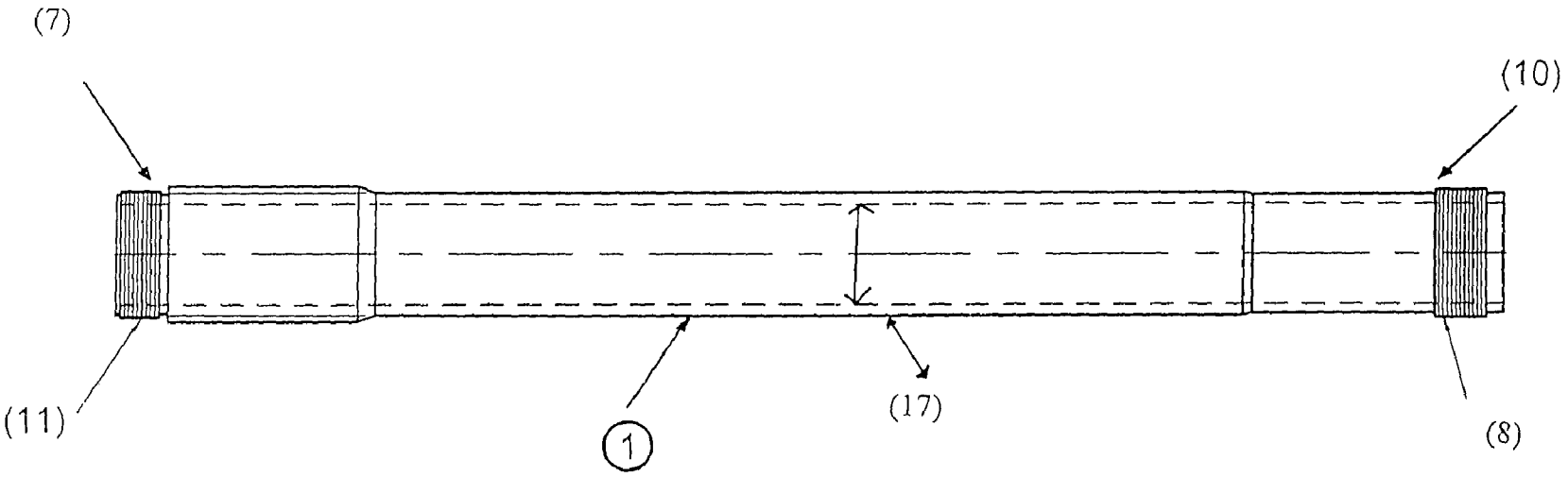
FIG. 7 is a perspective view of the universal barrel contemplated by the present invention.

FIGS. 1 and 7 show a pneumatic paintball universal barrel (1) of the present invention. The universal barrel (1) comprises a breech end (7) and a discharge muzzle end (8). The universal barrel (1) has an interior diameter (17) and comprises a hollow elongated cylindrical tube (4) that extends from the breech end (7) to the discharge muzzle end (8). The breech end (7) of the universal barrel (1) has a connection means (11) adapted for connection with barrel connection (12) of the adaptor (3). The adaptor (3) is adapted for connection to the front end of the marker by a connection means. The discharge muzzle end (8) of the universal barrel (1) is located at the opposite end of the marker (not shown) and allows for a paintball to discharge from the back portion of the marker body through the front portion of the marker body through the insert (4) which is embodied by the adaptor (3) and then through the universal barrel (1) and finally through the muzzle (2) to mark its intended target.

Figure 2:
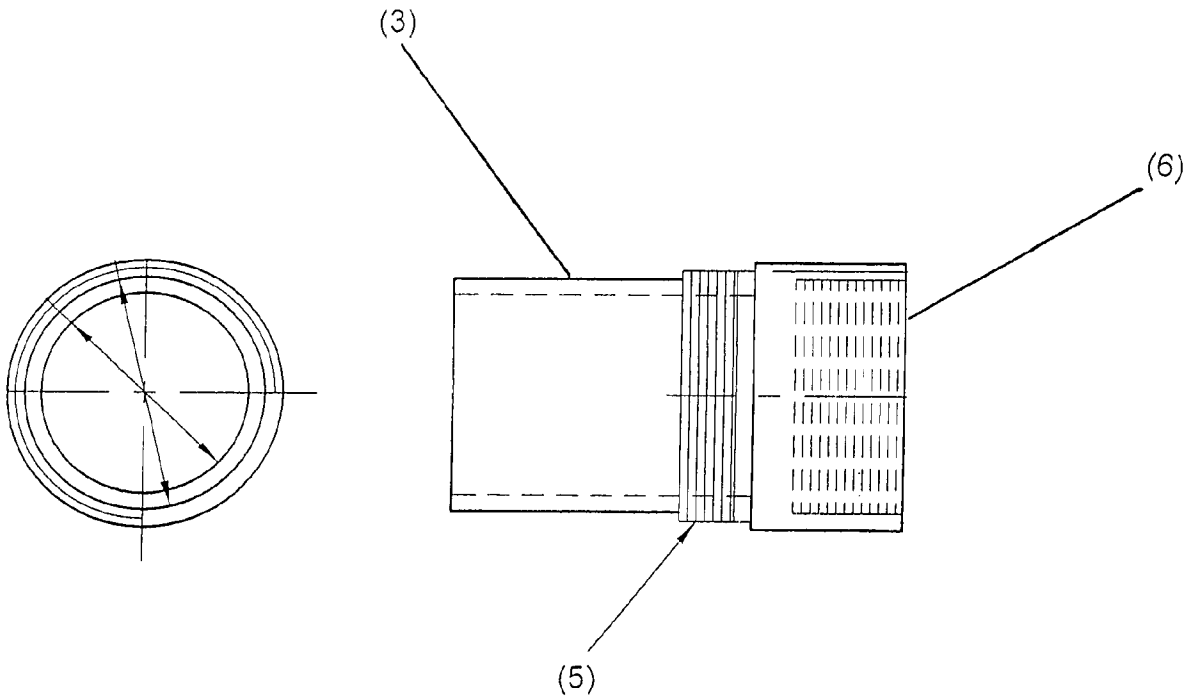
FIG. 2 is a cross-section side view of one of the adaptors of the present invention.
Figure 3:
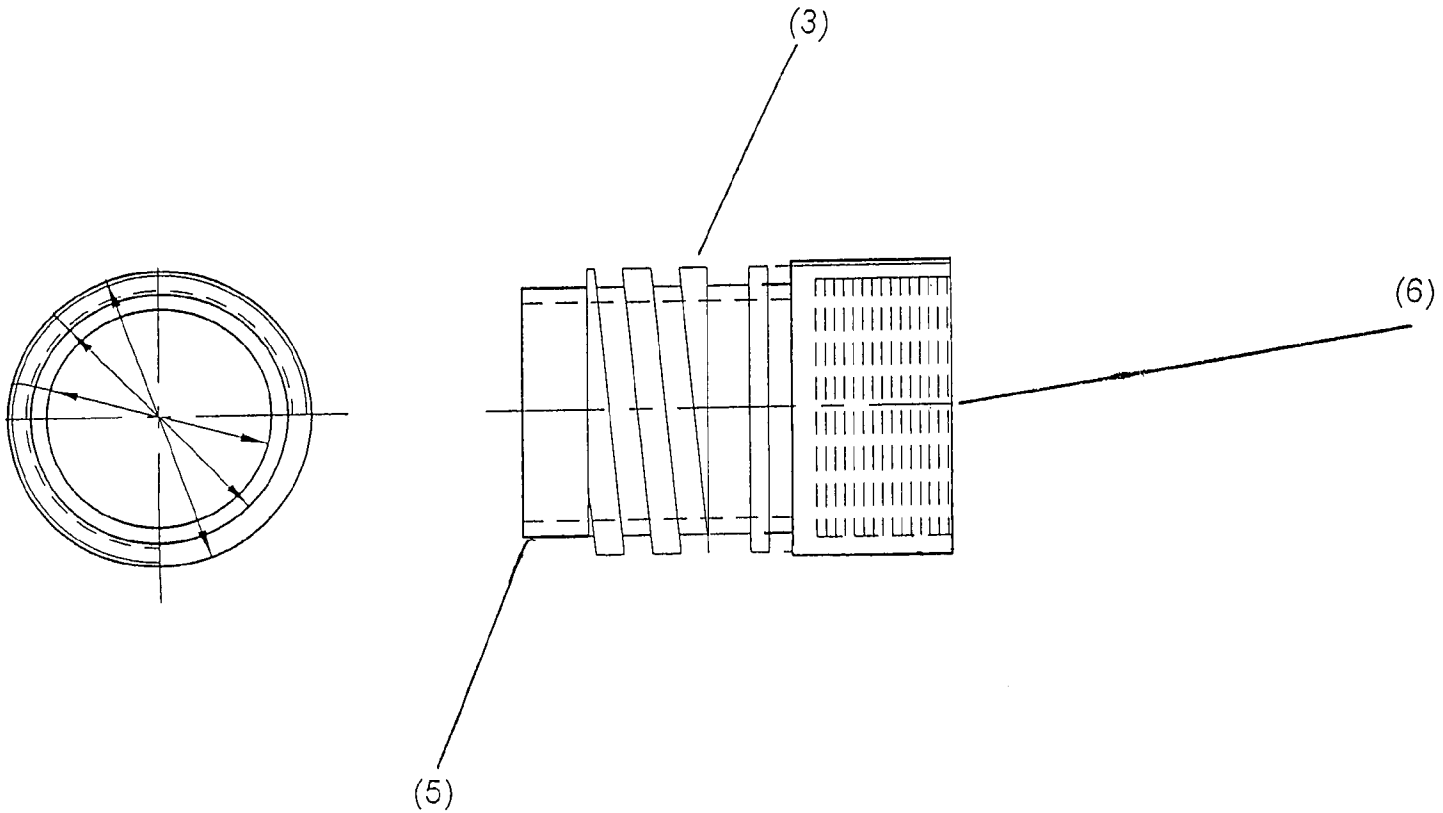
FIG. 3 is a cross-sectional view of another adaptor contemplated by the present invention.

The adaptor (3) can be adapted to connect to the breech end (7) of the universal barrel (1) by reverse screwing the internal threads (12) on the adaptor (3) barrel connection to the breech end of the universal barrel (1). The internal threads (12) of the barrel connection (6) of the adaptor (3) are identical on all adaptors (3) contemplated by the present invention and only connect to the breech end (7) of the universal barrel (1). The marker end (5) on the adaptor (3) comprises an external thread (13) that is adapted to accommodate the many different types of pneumatic paintball markers on the market. Depending on the marker diameter, an appropriate adaptor in the kit will be used. As contemplated by the present invention, a kit will comprise one or more adaptors, to correspond with the size the majority of available markers on the market. This allows a paintball player to change marker bodies without requiring a player to purchase a new barrel due to the different threads on the marker. The means of connection of the marker end (13) of the adaptor (3) can be of any numerous types as shown in FIGS. 2 and 3. For example, but not limited to, a snap-on type connection means, a cam-lock connection means or a threaded connection means.

Figure 4:
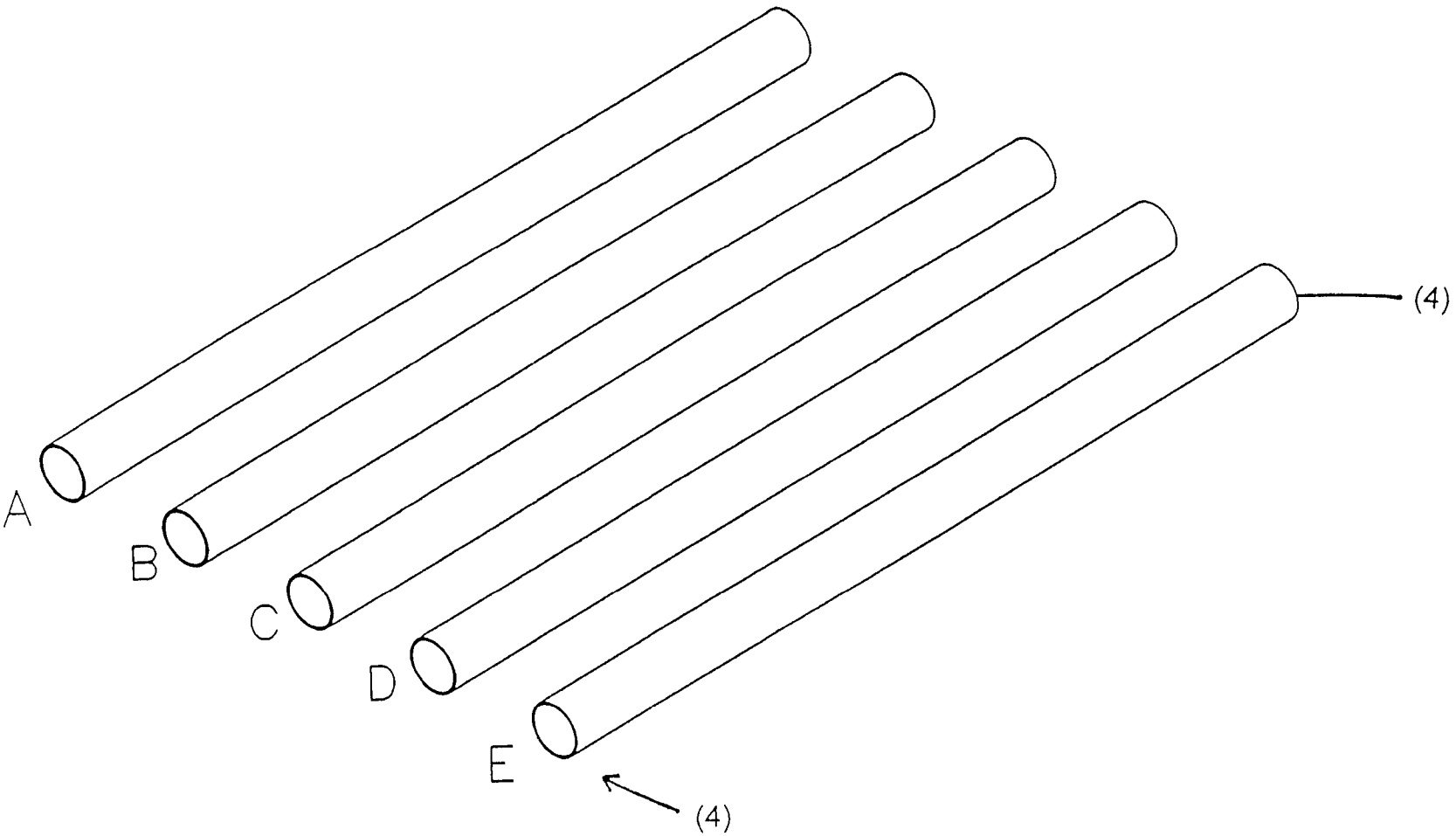
FIG. 4 is a perspective view of the removable tubular sleeve inserts contemplated by the present invention.
Figure 5:
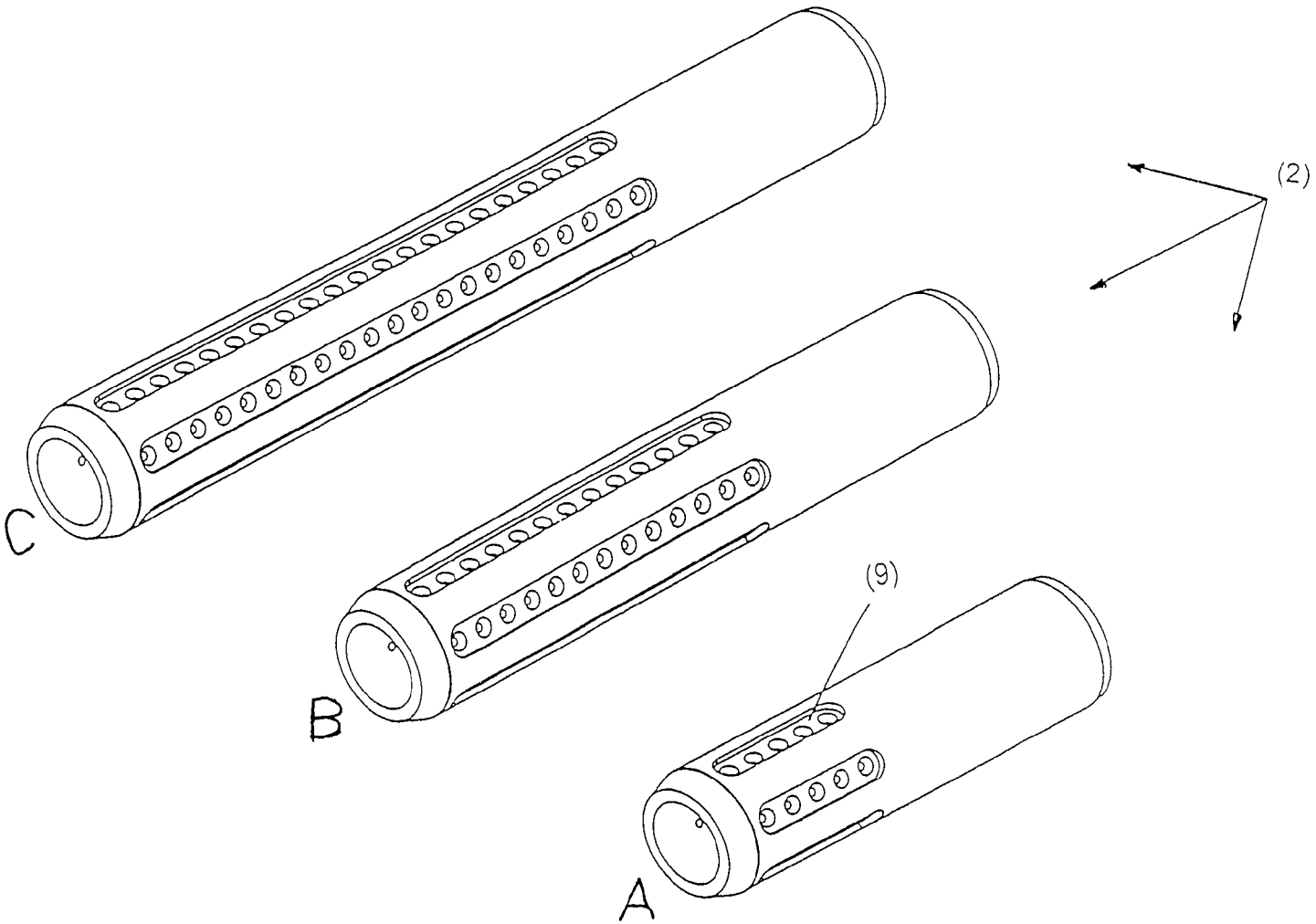
FIG. 5 is a perspective view of the muzzle extension pieces contemplated by the present invention.
Figure 6:
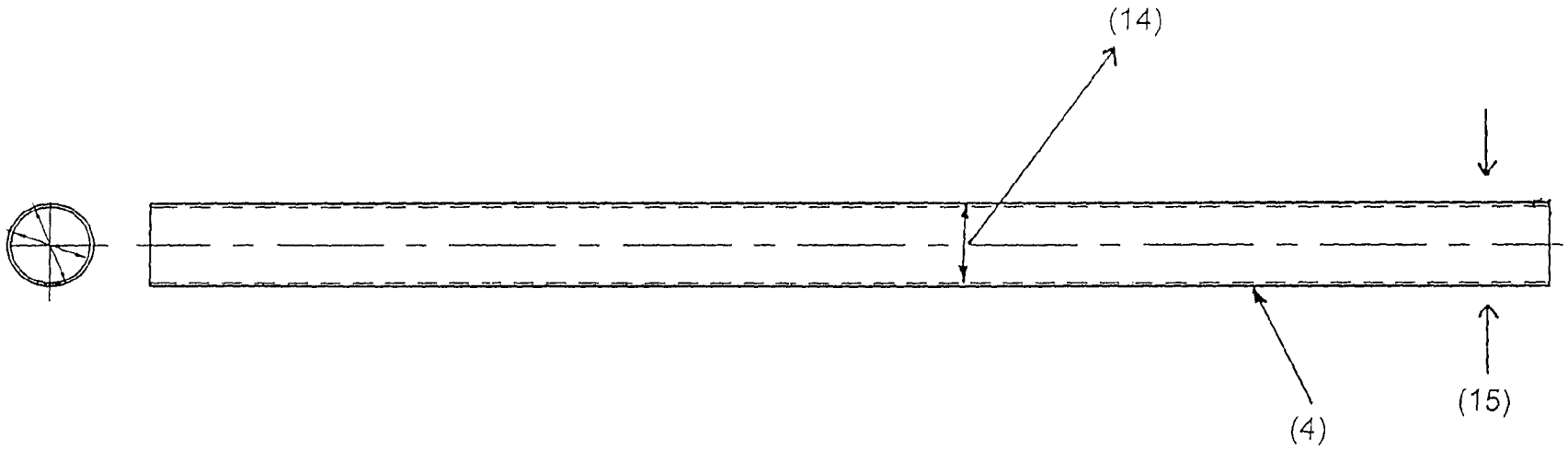
FIG. 6 is a cross-section view of one of the removable tubular barrel sleeve inserts contemplated by the present invention.

As shown in FIGS. 1, 4 and 6, a removable tubular barrel sleeve insert (4) is adapted to be inserted into the universal barrel (1) and to extend the entire length of the universal barrel (1) and adaptor (3). The insert (4) can be of any length, but must extend the entire length of the universal barrel (1) and adaptor (3). The insert comprises a hollow elongated tube with an inside diameter (14) and an outside diameter (15). The outside diameter (15) of the insert is slightly smaller than the inside diameter (17) of the universal barrel (1) and adaptor (3). When the insert (4) is inserted into the universal barrel (1), it forms a continuous path for the projection of a discharged paintball from a paintball marker. The inside diameter (14) of the insert (4) is selected to provide a snug fit with the paintball being fired from the paintball marker. Preferably, the choice of insert (4) is directly dependent on the size of the paintball to be fired. If the internal diameter of the insert (4) is too large, there will be a decrease in velocity, distance and accuracy. A too loose a fit may also cause the paintball to fall out of the universal barrel. If the inside diameter (14) of the insert (4) is too small, the velocity of the paintball will also be decreased and the paintball may also break within the universal barrel. Furthermore, a snug fitting insert chosen in association with a particularly sized paintball will ensure that the flow of compressed gas is properly transferred to the paintball, as the paintball is pushed through the insert (4) toward the discharge muzzle end (8) of the universal barrel (1). The inserts (4) can be made from, for example, any material, such as aluminum, bronze, brass or Teflon or any suitable material that will be able to handle the paintball during its projection through the insert (4). The inside of the inserts may be coated with, for example, ceramic, oil or Teflon, or any suitable material that will result in a smooth lubricated surface for the projection of the paintball through the insert. The inserts extend from the beginning of the marker end of the adaptor and through the entire universal barrel. The inserts may be of various lengths and extend up to 12 inches long or more and the inside diameter of the inserts may vary from at least 0.670 inches to about at least 0.695 inches as shown in FIGS. 4 and 6. Furthermore, there are at least seven different types of inserts (4) having different inside diameters (14) which fit the various sizes of paintballs manufactured and can easily be inserted into and extend the entire length of the universal barrel (1) and adaptor (3).

FIG. 4 shows a set of inserts (4) having a variety of inside diameters (14). A preferred set of inserts includes at least five-barrel inserts. A first insert has an inside diameter of 0.682 inches. A second insert has an inside diameter of 0.684 inches. A third insert has an inside diameter of 0.686 inches. A fourth insert has an inside diameter of 0.688 inches. A fifth insert has an inside diameter of 0.690 inches. A sixth insert has an inside diameter of 0.692 inches. A seventh insert has an inside diameter of 0.694 inches. Other various sized inserts are also contemplated by the present invention. The invention is also a kit (20) as shown in FIG. 1. In the kit (20), there is one or more adaptor(s) (3), each having a marker end (5) adapted for connection with existing markers on the market one or more inserts (4) that are inserted into the barrel of the marker and one or more muzzles (2). In a preferred embodiment, the connection means on the marker end of the adaptor comprises a thread that is adapted for connection with the selected marker. The adaptor (3) also comprises a barrel connection (6) having an internal thread adapted for connection with the universal barrel (1). A player may use the kit (20) by selecting the appropriate adaptor (3) in accordance with the marker that they intend to use. A player can also select the appropriate insert (4) in accordance with the size of paintball to be used with the paintball marker. At all times the same universal barrel may be used. In a different embodiment, the player can increase the length of the universal barrel (1) by connecting a muzzle extension (2) at the discharge muzzle end (8) of the universal barrel (1). The muzzle extension (2) has progressive vented holes (9) near the firing end (21) of the muzzle extension (2). The progressive vented holes (9) help decrease the noise when the paintball is being discharged from the paintball marker.

This invention provides paintball players with an inexpensive and easy method for using a universal barrel, an adaptor and removable tubular barrel sleeve inserts, and exchangeable variable length muzzle ends in combination with multiple markers on the market.

Having thus described the invention, it should be apparent that many structural adaptations may be implemented without departing from the scope of the present invention as set forth above and as described herein below by the claims.

I claim:

1. A pneumatic paintball marker adapter kit for use with a plurality of pneumatic paintball markers, each marker including a marker body with a back portion and a front portion, the back portion being adapted to receive a paintball, the front portion being adapted to detachably connect with a barrel to discharge a paintball through the barrel, and the plurality of markers having front portions of different sizes, the kit comprising:

(a) a universal barrel comprising a hollow, elongated cylindrical tube having an interior diameter, a paintball discharge muzzle end, a breech end and a connection means at the breech end;

(b) a plurality of adaptors, each adaptor having a body with a hollow cylindrical tube, a marker end adapted for connection with the front portion of a marker and a barrel connection adapted for detachable connection with the breech end of the universal barrel, said body having an internal diameter equal to the internal diameter of the universal barrel;

(c) the barrel connection of each adapter being the same size, for connection to the breech end of the universal barrel, and the marker end of each adapter being of a different size for connection to the plurality of makers having front portions of different sizes;

(d) said universal barrel being substantially longer than said adapters;

(e) a plurality of muzzle extensions of various lengths, each muzzle extension comprising a hollow cylindrical body, a discharge end to discharge said paintball and a muzzle end adapted for connection with the muzzle end of the universal barrel; and (f) a plurality of removable tubular barrel sleeve inserts adapted to be inserted within the adaptors and the universal barrel and to extend an entire length of an assembly of the universal barrel and an adaptor, said inserts including a hollow elongated cylindrical tube with an inside diameter and an outside diameter, the outside diameter being slightly smaller than the internal diameter of the universal barrel and the adaptor to form a continuous path for the projection of a paintball discharged from the paintball marker.

2. The pneumatic kit of claim 1, wherein each insert has an inside diameter from at least about 0.670 inches to at least about 0.695 inches.

3. A pneumatic paintball marker adapter kit for use with a plurality of pneumatic paintball markers, each marker including a marker body with a back portion and a front portion, the back portion being adapted to receive a paintball, the front portion being adapted to detachably connect with a barrel to discharge a paintball through the barrel, and the plurality of markers having front portions of different sizes, the kit comprising:

(a) a universal barrel comprising a hollow, elongated cylindrical tube having an interior diameter, a paintball discharge muzzle end, a breech end and a connection means at the breech end;

(b) a plurality of adaptors, each adaptor having a body with a hollow cylindrical tube, a marker end adapted for connection with the front portion of a marker and a barrel connection adapted for detachable connection with the breech end of the universal barrel, said body having an internal diameter equal to the internal diameter of the universal barrel;

(c) the barrel connection of each adapter being the same size, for connection to the breech end of the universal barrel, and the marker end of each adapter being of a different size for connection to the plurality of makers having front portions of different sizes;

(d) said universal barrel being substantially longer than said adapters; and (e) a plurality of removable tubular barrel sleeve inserts adapted to be inserted within the adaptors and the universal barrel and to extend an entire length of an assembly of the universal barrel and an adaptor, said inserts including a hollow elongated cylindrical tube with an inside diameter and an outside diameter, the outside diameter being slightly smaller than the internal diameter of the universal barrel and the adaptor to form a continuous path for the projection of a paintball discharged from the paintball marker.

4. The pneumatic kit of claim 3, wherein each insert has an inside diameter from at least about 0.670 inches to at least about 0.695 inches.

* * * * *